US006199247B1

(12) United States Patent
Tsai

(10) Patent No.: US 6,199,247 B1
(45) Date of Patent: Mar. 13, 2001

(54) CLASP DEVICE FOR SHEET MATERIALS

(76) Inventor: Kuo Yang Tsai, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/354,911

(22) Filed: Jul. 7, 1999

(51) Int. Cl.[7] ..... A44B 21/00
(52) U.S. Cl. ..... 24/343; 24/459
(58) Field of Search ..... 24/343, 459, 90.5, 24/369, 716

(56) References Cited

U.S. PATENT DOCUMENTS 2,435,082 * 1/1948 Huber ..... 24/459
2,454,103 * 11/1948 Swidersky ..... 24/459
4,175,305 * 11/1979 Gillis ..... 24/459
4,660,240 * 4/1987 Hutton et al. ..... 24/459
4,757,662 * 7/1988 Gasser ..... 24/459
5,046,222 9/1991 Byers et al. ..... 24/343
5,209,029 * 5/1993 Foerst ..... 24/459
5,655,271 * 8/1997 Maxwell-Trumble et al. ..... 24/459

* cited by examiner

*Primary Examiner*—Victor N. Sakran

(57) ABSTRACT

A clasp device includes a frame and a button for clasping a sheet material between the frame and the button by women and children without a great force. The button is engaged in an opening of the frame and includes an annular flange having a size greater than the opening of the frame for engaging with the frame and for preventing the button from being disengaged from the frame. The frame has one or more stops engaged with the annular flange of the button for securing the button to the frame and for preventing the button from being disengaged from the frame.

4 Claims, 3 Drawing Sheets

CLASP DEVICE FOR SHEET MATERIALS

BACKGROUND OF THE INVENTION

1. Field of the Invention

The present invention relates to a clasp device, and more particularly to a clasp device for fabrics, films, and sheet materials.

2. Description of the Prior Art

A typical clasp device for clasping fabrics, films and sheet materials are disclosed in U.S. Pat. No. 5,046,222 to Byers et al. and comprise a body having a rounded opening formed therein and defined by a frame section for receiving a button member. The button member includes an annular groove defined between a pair of annular walls; in which one of the annular walls should be engaged through the frame section together with the sheet material by force. Children and women may not easily engage the button member into the frame second of the body.

The present invention has arisen to mitigate and/or obviate the afore-described disadvantages of the conventional clasp devices for sheet materials.

SUMMARY OF THE INVENTION

The primary objective of the present invention is to provide a clasp device for allowing the fabrics, films and sheet materials to be easily clasped in place by children and women.

In accordance with one aspect of the invention, there is provided a clasp device for clasping a sheet material, the clasp device comprising a frame including an opening formed therein and including a notch formed therein and communicating with the opening for increasing a size of the opening, a button including a body having a size for engaging in the opening of the frame, the body including an annular flange extended radially outward therefrom and having a size greater than the opening of the frame for engaging with the frame and for preventing the button from being disengaged from the frame, and the frame including at least one stop extended therefrom and engaged with the annular flange of the button for securing the button to the frame and for preventing the but ton from being disengaged from the frame.

The frame includes an inner peripheral surface for defining the opening thereof, and includes at least one depression formed in the inner peripheral surface thereof for receiving the sheet material when the sheet material is engaged between the button and the frame.

The frame includes a peripheral shoulder formed therein and communicating with the opening of the frame for receiving the annular flange of the button. The frame includes a serrated peripheral surface formed therein for defining the annular shoulder of the frame and for engaging with the sheet material when the sheet material is engaged between the annular flange of the button and the frame.

The frame includes an upper surface and includes at least one bulge extended upward beyond the upper surface of the frame, the stop of the frame is extended from the bulge of the frame for engaging with the annular flange of the button.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 4:
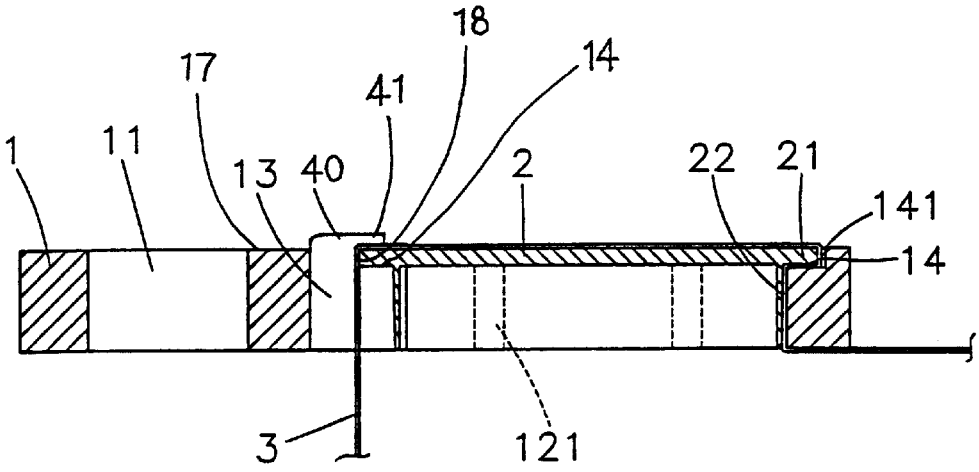
FIGS. 3 and 4 are cross sectional views taken along lines 3—3 and 4—4 of FIG. 2 respectively.
Figure 3:
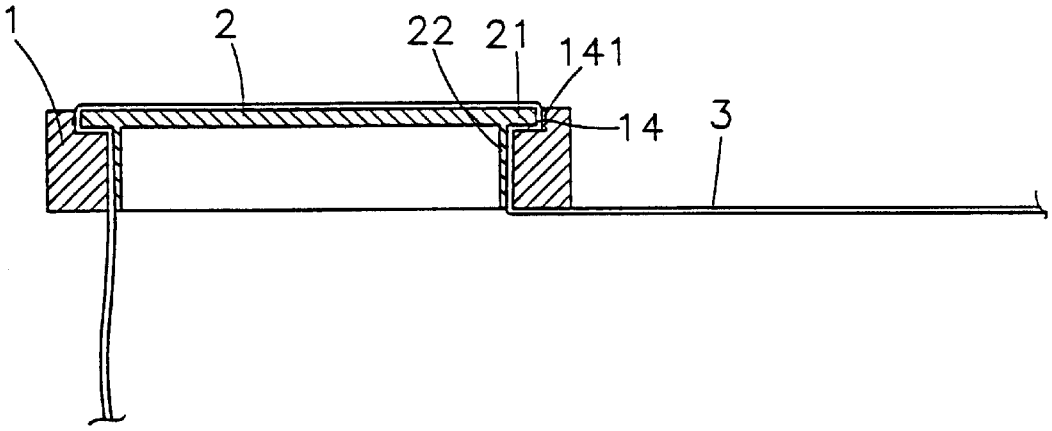

Referring to the drawings, and initially to FIGS. 1–4, a clasp device in accordance with the present invention comprises a frame 1 including an opening 12 formed therein and defined by an inner peripheral surface 10 for receiving a button 2. The frame 1 including a hole 11 or a hook formed therein for hanging purposes, and includes one or more depressions 121 formed in the inner peripheral surface 10. The frame 1 includes a peripheral shoulder 14 formed in the upper portion thereof and preferably concentric with the opening 12 of the frame 1, and includes a serrated peripheral surface 141 for defining the peripheral shoulder 14. The frame 1 further includes a notch 13 formed therein and preferably formed between the hole 11 and the opening 12 and communicating with the opening 12. The frame 1 includes one or more bulges 40 extended upward beyond the upper surface 17 of the frame 1 and includes one or more stops 41 extended from the bulges 40 respectively and extended inward of the peripheral shoulder 14 of the frame 1, best shown in FIG. 4, for defining a gap 18 between the stops 41 and the frame 1 (FIG. 4).

The button 2 includes a cylindrical body 22 for engaging into the opening 12 of the frame 1 and includes an annular flange 21 extended laterally or radially outward from the cylindrical body 22 for engaging with the peripheral shoulder 14 of the frame 1 and for securing the button 2 to the frame 1. The stops 41 are engaged with the annular flange 21 of the button 2 (FIGS. 2, 4) such that the button 2 may be secured to the frame 1 and will not be disengaged from the frame 1. The annular flange 21 of the button 2 has a size greater than that of the opening 12 of the frame 1 for engaging with the frame 1 and for securing the button 2 to the frame 1.

Figure 5:
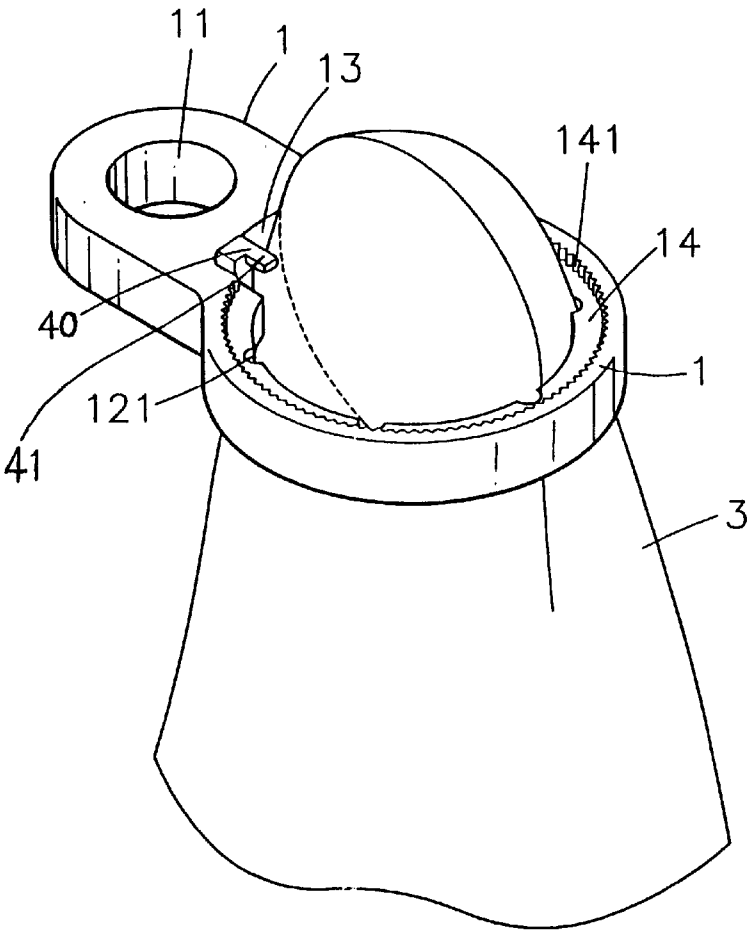
FIG. 5 is a perspective view illustrating the engagement of a button member into a frame of the clasp device.
Figure 1:
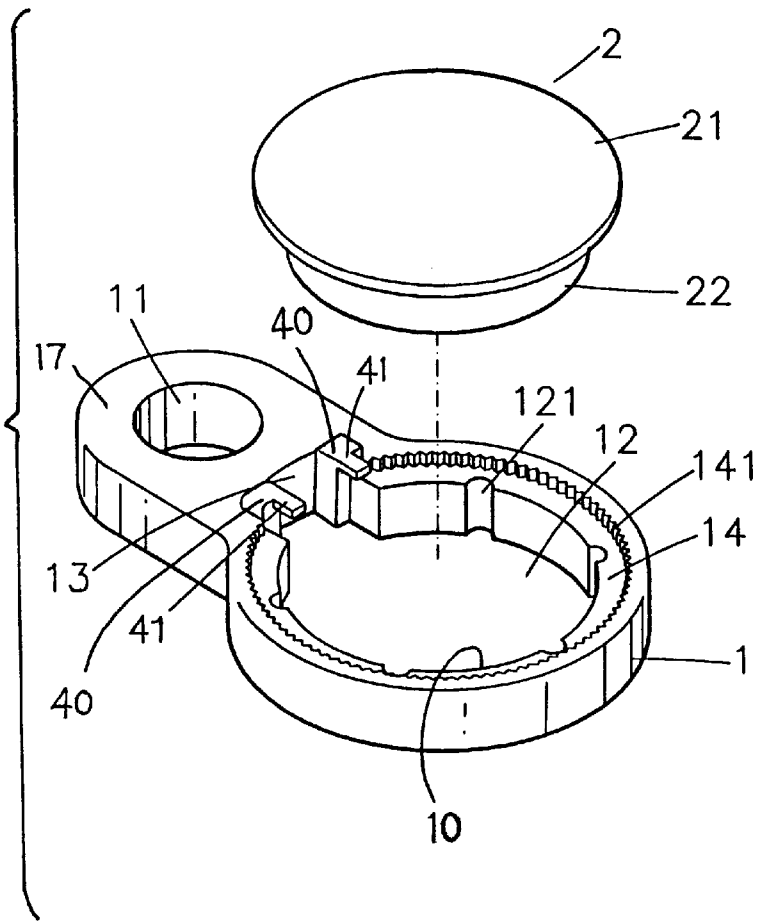
FIG. 1 is an exploded view of a clasp device in accordance with the present invention.
Figure 2:
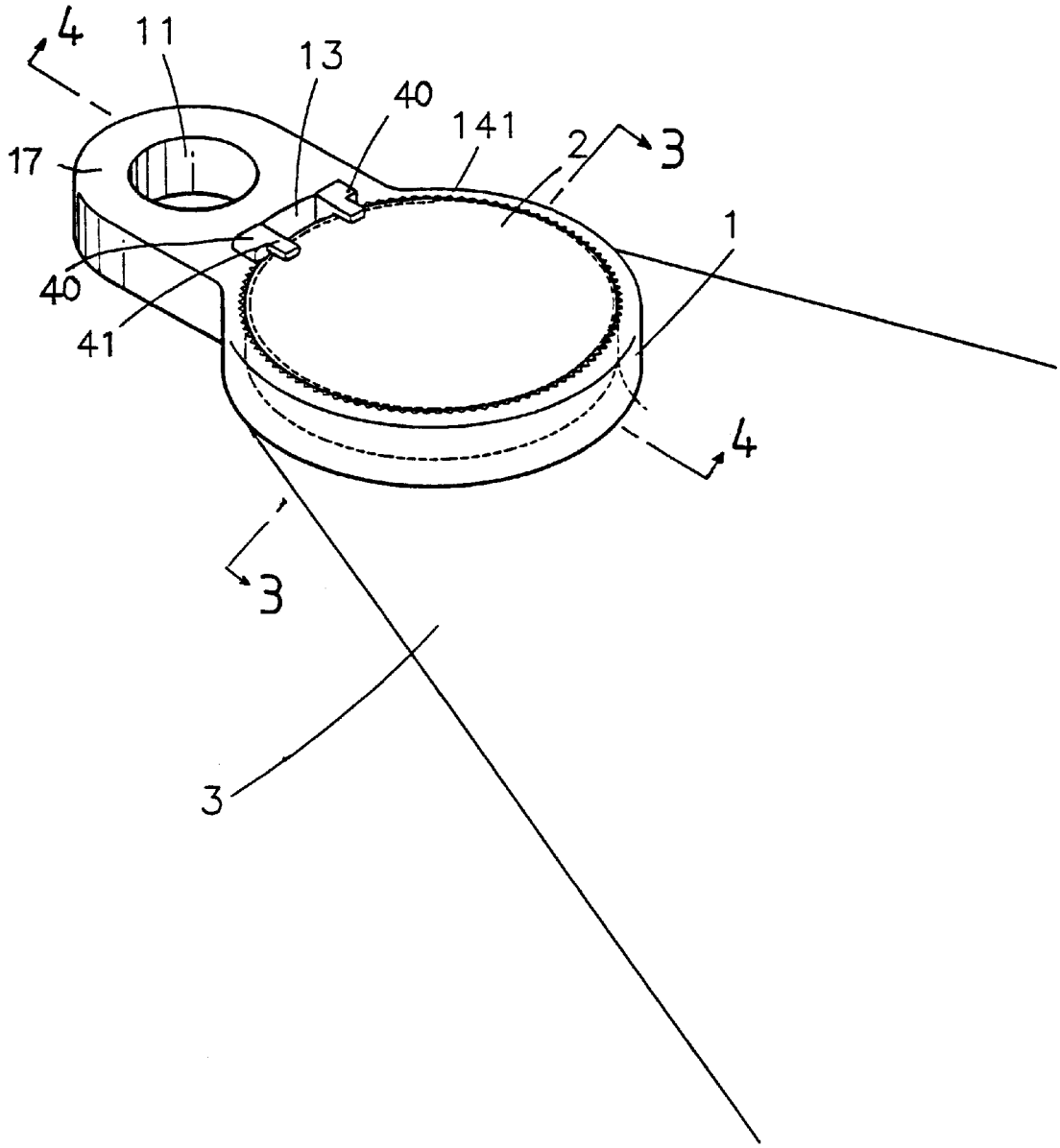
FIG. 2 is a perspective view of the clasp device.

In operation, as shown in FIG. 5, the notch 13 of the frame 1 is provided for increasing the size of the opening 12 of the frame 1 such that the annular flange 21 of the button 2 that is engaged within a piece of fabric material or film material or sheet material 3 may be engaged through the notch 13 and the opening 12 of the frame 1. One portion of the annular flange 21 of the button 2 may first be engaged into the gap 18 defined between the stops 41 and the frame 1 before the cylindrical body 22 of the button 2 is engaged into the opening 12 of the frame 1. It is to be noted that the annular flange 21 of the button 2 is not required to be engaged through the opening 12 of the frame 1 by force as that required by the typical clasp devices. The engagement of the stops 41 with the annular flange 21 of the button 2 may prevent the button 2 from moving away from the frame 1 or from moving relative to the frame 1 in a direction perpendicular to the frame 1.

It is further to be noted that the sheet material 3 engaged between the button 2 and the frame 1 may provide a force-fitted engagement between the button 2 and the frame 1. A portion of the sheet material 3 and particularly the crease portions of the sheet material 3 may be received in the depressions 121 of the frame 1 such that the sheet material 3 may be flatly and snugly engaged between the button 2 and the frame 1. The sheet material 3 and/or the annular flange 21 of the button 2 may further be solidly secured to the frame 1 by the engagement with the serrated peripheral surface 141 of the frame 1. The annular flange 21 of the button 2 may also be directly engaged on the upper surface 17 of the frame 1 and may also include a portion engaged between the stops 41 and the frame 1 such that the button 2 may also be solidly secured to the frame 1 without forming the peripheral shoulder 14 in the frame 1.

Accordingly, the clasp device in accordance with the present invention may be used to easily clasp the fabrics, films and sheet materials into the frame by children and women, without a great force.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A clasp device for clasping a sheet material, said clasp device comprising:

a frame including an opening formed therein and including a notch formed therein and communicating with said opening of said frame, said frame including an upper portion having a peripheral shoulder formed therein and communicating with said opening of said frame, said frame including at least one stop extended upward from said upper portion thereof and extended radially inward of said opening of said frame, and a button including a body received in said opening of said frame for clasping the sheet material between said body of said button and said frame, said body including an upper portion having an annular flange extended radially outward therefrom and having a size greater than that of said opening of said frame, said annular flange of said body being engaged in said peripheral shoulder of said frame and engaged with said frame for preventing said button from being disengaged from said frame and for further clasping the sheet material between said annular flange of said body and said frame, and said at least one stop of said frame being extended radially inward of said opening of said frame to engage with said annular flange of said button for securing the sheet material and said button to said frame and for preventing the sheet material and said button from being disengaged from said frame.

2. The clasp device according to claim 1, wherein said frame includes a serrated peripheral surface formed therein for defining said annular shoulder of said frame and for stably securing the sheet material between said annular flange of said button and said serrated peripheral surface of said frame.

3. The clasp device according to claim 1, wherein said frame includes an inner peripheral surface for defining said opening thereof, and includes at least one depression formed in said inner peripheral surface thereof for receiving the sheet material when the sheet material is engaged between said button and said frame.

4. The clasp device according to claim 1, wherein said frame includes at least one bulge extended upward beyond said upper portion of said frame, said at least one stop of said frame is extended from said at least one bulge of said frame and extended radially inward of said opening of said frame for engaging with said annular flange of said button.

* * * * *